United States Patent [19]

Matsuura

[11] 3,941,257

[45] Mar. 2, 1976

[54] MULTI-STAGED AUTOMOBILE PARKING APPARATUS

[76] Inventor: Takashi Matsuura, 28-4 Izumi 2-chome, Suginami, Tokyo, Japan

[22] Filed: Mar. 5, 1974

[21] Appl. No.: 448,432

[30] Foreign Application Priority Data

June 12, 1973 Japan ..... 48-66176
Sept. 16, 1973 Japan ..... 48-104186
Oct. 12, 1973 Japan ..... 48-114455

[52] U.S. Cl. ..... 214/16.1 ED; 187/8.77; 214/139
[51] Int. Cl.[2] ..... E04H 6/06
[58] Field of Search ..... 214/16.1 ED, 16.1 R, 139, 214/505, 16 E, 16.1 EC; 187/8.77, 8.41

[56] References Cited

UNITED STATES PATENTS 3,786,940 1/1974 Klaus ..... 214/16.1 ED

FOREIGN PATENTS OR APPLICATIONS 998,458 7/1965 United Kingdom ..... 214/16.1 ED

*Primary Examiner*—Robert G. Sheridan
*Assistant Examiner*—R. B. Johnson
*Attorney, Agent, or Firm*—Ladas, Parry, Von Gehr, Goldsmith & Deschamps

[57] ABSTRACT

A multi-stage parking apparatus has vertically movable pallets for supporting parked cars. The pallets are connected at one end to support arms which are pivotal about a horizontal axis. The other end of the pallets is connected to a fixed guide track. A power source is connected to the pallet and support arm to facilitate the vertical movement of the pallets.

9 Claims, 19 Drawing Figures

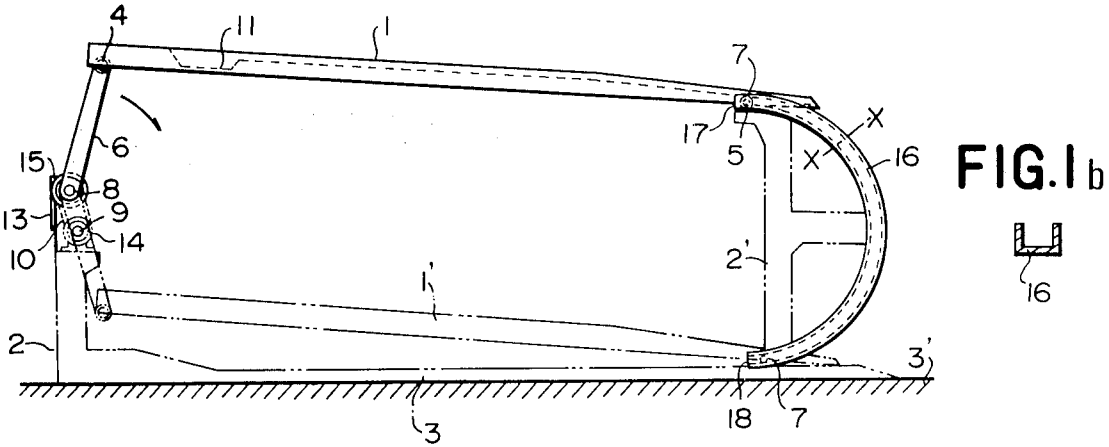
FIG.1b
16
FIG.1a
1
1'
2
2'
3
3'
4
5
6
7
8
9
10
11
13
14
15
16
17
18
X
X
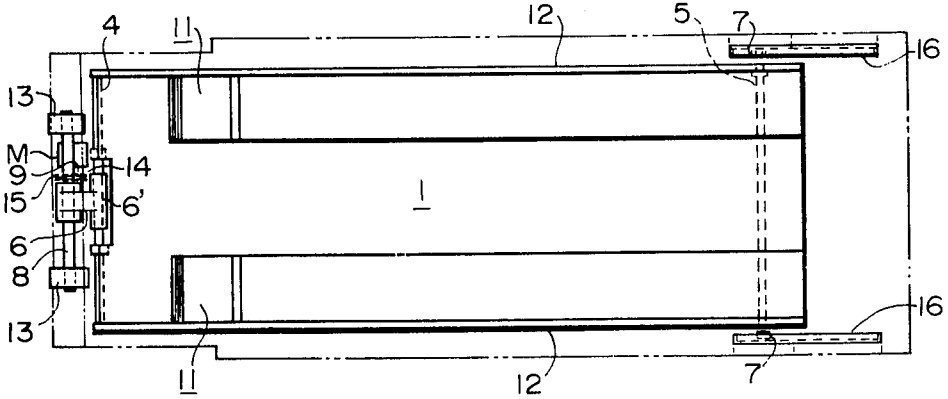
FIG.2
1
4
5
6
6'
7
8
9
11
12
13
14
15
16

A
B
C
R1
R2
R3
X
X
a
b
c
E
P
S
M
101
103
104
106
107
108
110
112
113
114
115
117
119
120
121
122
123
125
126
128
129
131
132
133
134
135

MULTI-STAGED AUTOMOBILE PARKING APPARATUS

This invention relates to an apparatus for parking automobiles on vertically arranged multi-stages.

A general object of the invention is to provide an effective use of parking space by means of the simple, strong and powerful lifting equipment of a particular mechanism having pallets which support automobiles.

Conventionally, the two-staged parking apparatus of a comparatively simple structure has been furnished with the cantilever type pallet support. In contrast to the said type pallet support, this invention has a structure which supports each pallet with the front and rear support shafts so that the strength of the individual pallet can be reduced enabling the weight thereof to be reduced and also the power required for lifting and lowering the pallet to be reduced.

A further improvement of this invention in the lifting and lowering of automobiles for vertically arranged parking thereof comprises stable motion of the lifting equipment by means of the front and rear shafts supporting each pallet as compared to the cantilever type support of the conventional apparatuses, and therefore the apparatus embodying this invention does not apply excessive load to its supporting mechanism at starting and stopping of the pallets.

In the drawings:

FIG. 1*a* shows a side elevational view of a first form of multi-stage automobile parking apparatus;

FIG. 1*b* shows a sectional view taken an the line X—X in FIG. 1*a;*

FIG. 2 shows a plan view of the first form of apparatus;

Figures 7A, 7B:
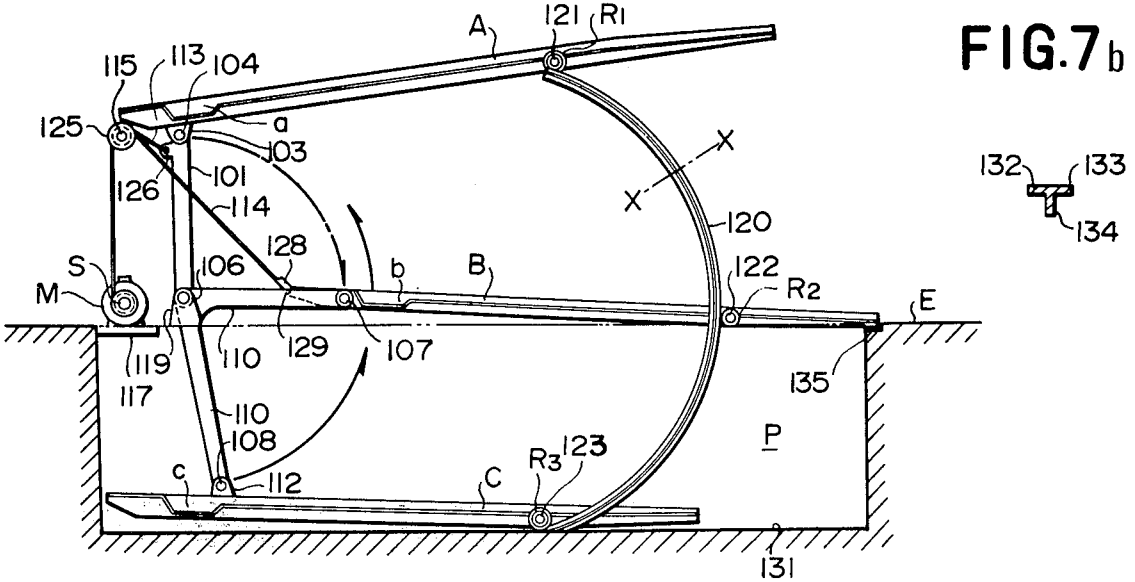

FIG. 7*a* shows a side elevational view of a third form of multi-stage automobile parking apparatus;

FIG. 7*b* shows a sectional view taken an the line X—X in FIG. 7*a;*

Figure 8:
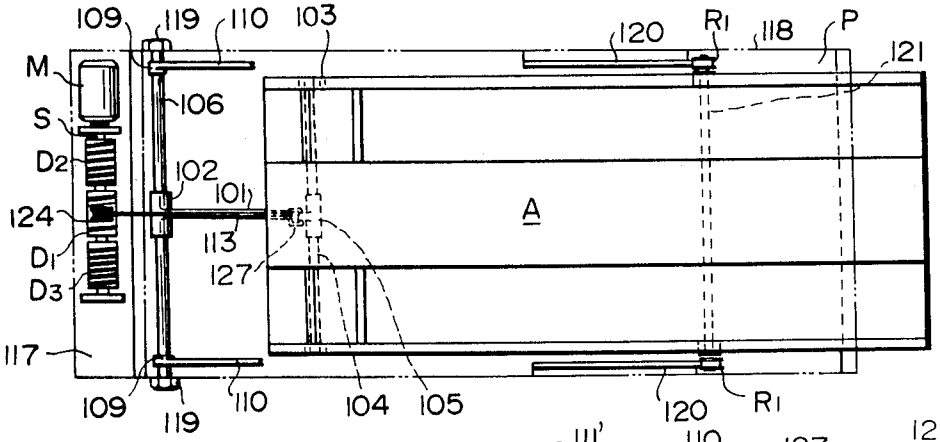
Figure 9:
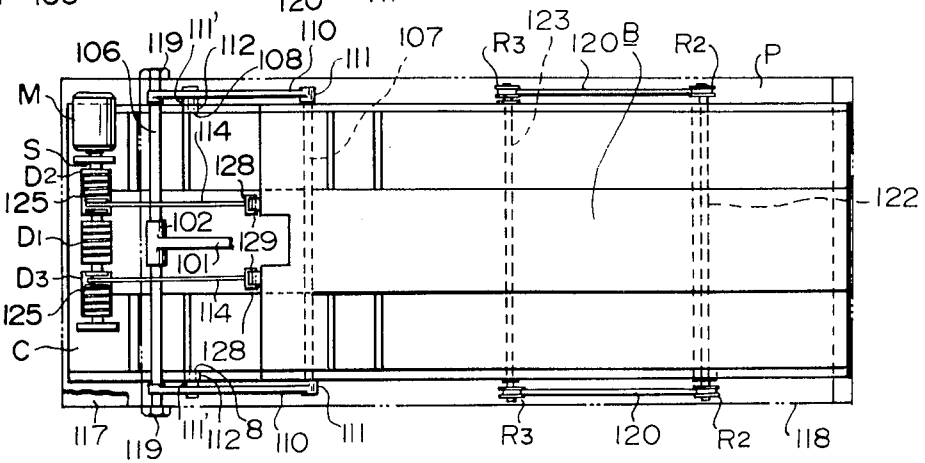
Figure 10:
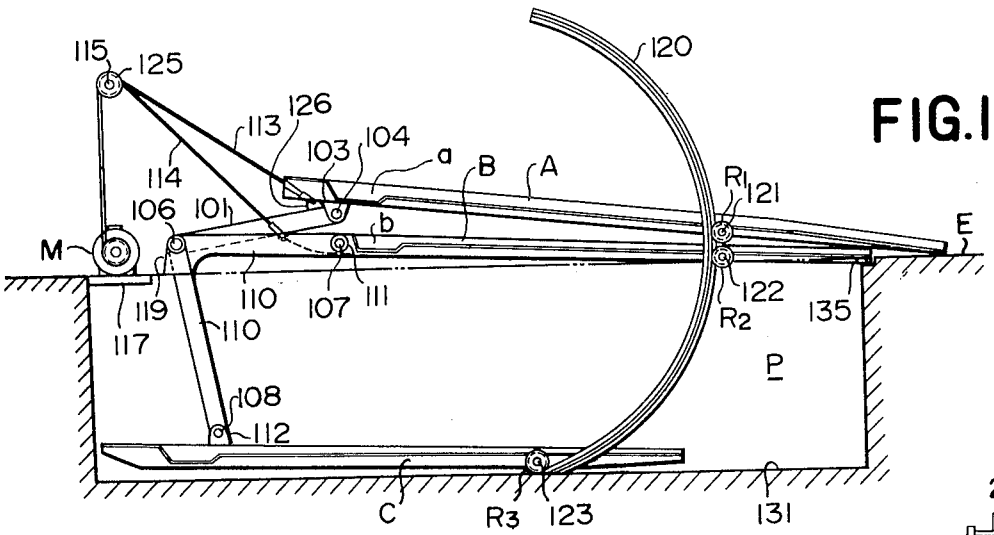
Figure 15:
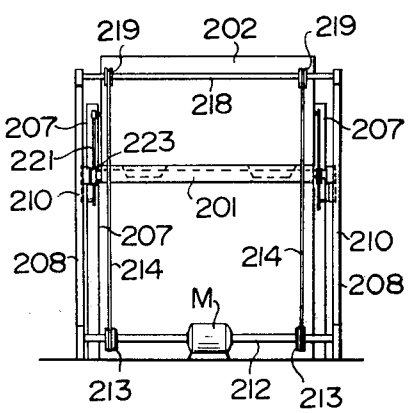
Figure 11:
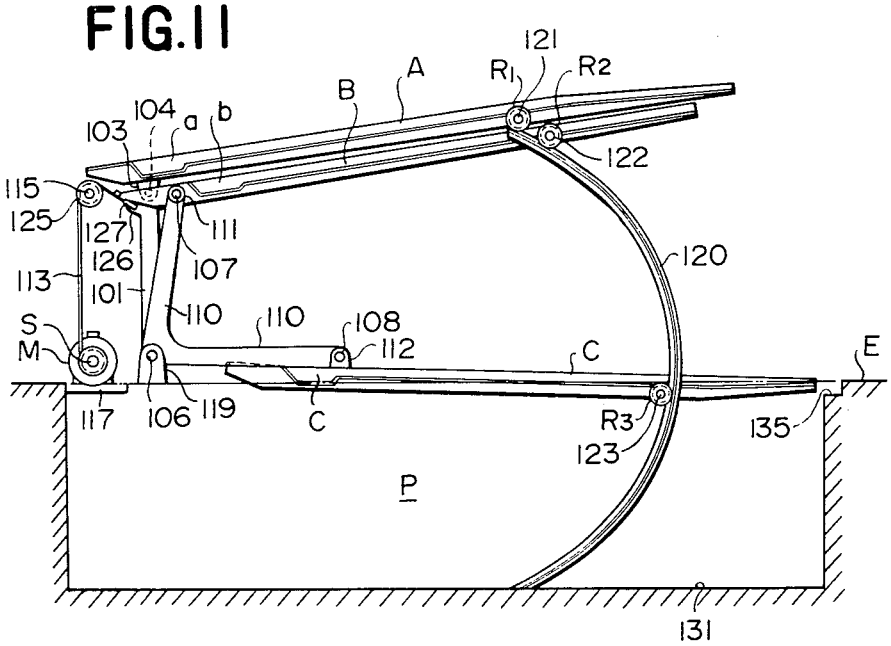
Figure 12:
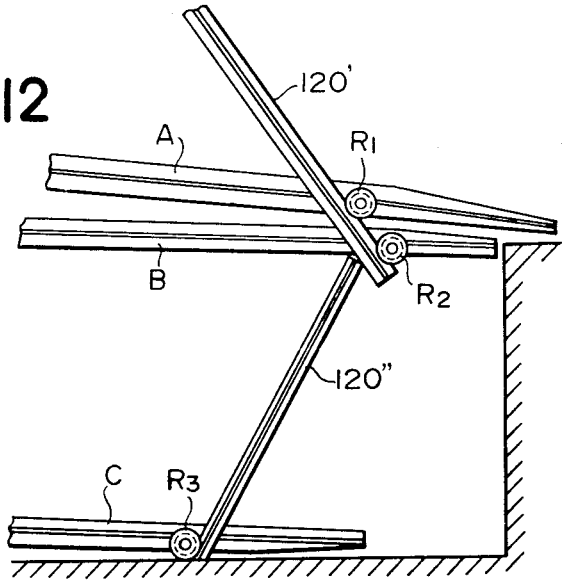
Figure 13:
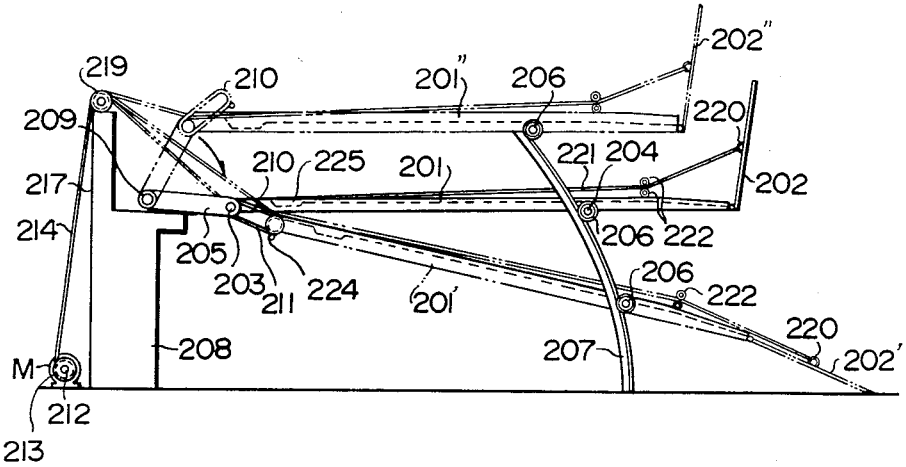
Figure 14:
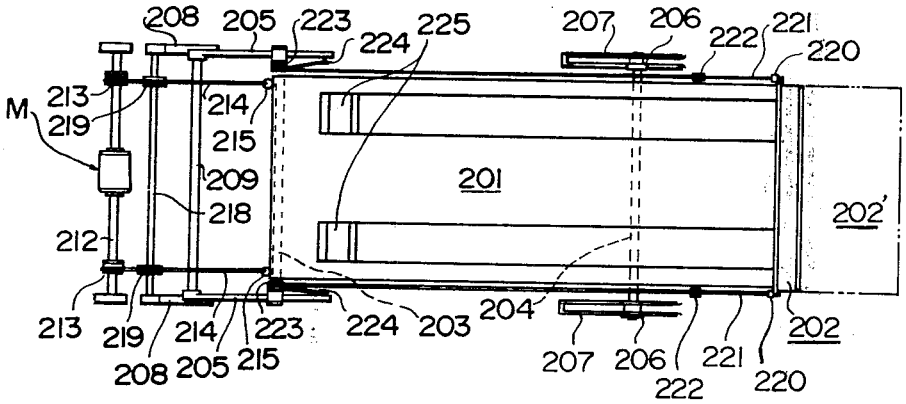
Figure 16:
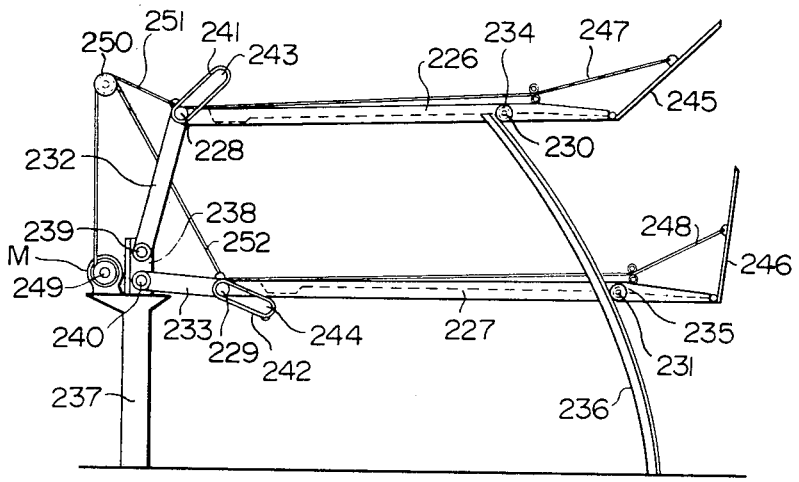
Figure 17:
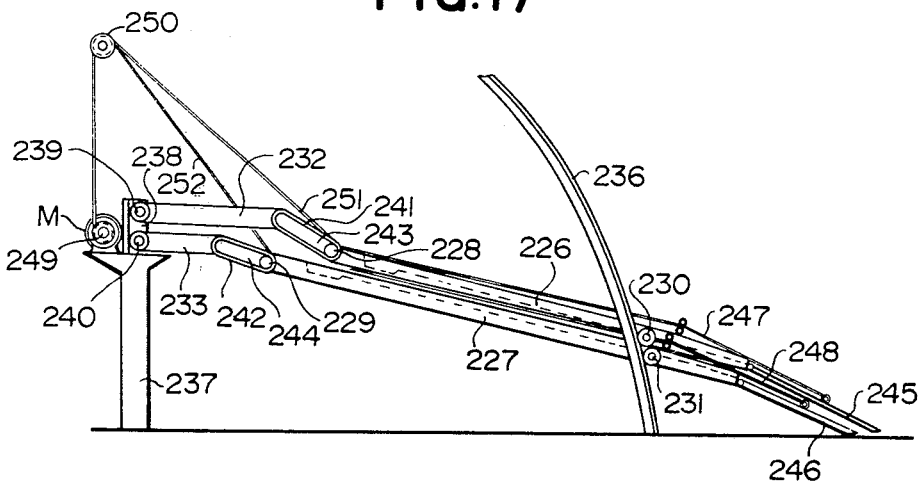

FIG. 8 shows a plan view of the third form of apparatus with the two lower pallets removed;

FIG. 9 shows a plan view of the third form of apparatus with the upper pallet removed;

FIG. 10 shows a side elevational view of the third form of apparatus with the upper pallet in its lowered position;

FIG. 11 shows a similar view with the two lower pallets in the raised position;

FIG. 12 shows a partial side elevation of a modification of the third form of apparatus;

FIG. 13 shows a side elevational view of a fourth form of multi-stage automobile parking apparatus;

FIG. 14 shows a plan view of the fourth form of apparatus;

FIG. 15 shows an end view of the fourth form of apparatus;

FIG. 16 shows a side elevational view of a fifth form of multi-stage automobile parking apparatus with its pallets in the raised position;

FIG. 17 shows a similar view with the pallets in the lowered position.

The first form of apparatus comprises the pallet 1, the front and rear support frames 2 and 2', for example of concrete, supporting the pallet lifting equipment of the parking apparatus, the concrete floor 3 connected to the ground 3' forming the lower automobile parking floor.

Under the front and rear parts of the pallet 1 (the left side of the pallet being called the front part and the right side the rear part in FIG. 1*a*) are held the support shafts 4 and 5 by means of brackets. The front support shaft 4 is rotatably held by a T-shaped pipe 6' installed at one end of the support arm 6, the other end of which forms a boss part through which the horizontal drive shaft 8 is inserted and fixed. The said drive shaft 8 is rotatably held by two support columns 13 installed on the concrete support frame 2.

At both ends of the rear support shaft 5 for the pallet are installed the rollers 7, which are fitted to and supported by the guide rails 16 fixed symmetrically on the right and the left inside surfaces located perpendicular to the concrete support frame 2'.

Each of the guide rails 16 has a U-shaped cross section and bends archwise with its lower end contacting the floor 3. FIG. 1*b* shows said U-shaped cross section at X—X. The U-shaped cross section of said left and right guide rails whose upper and lower ends 17 and 18 are closed are so installed that the open sections thereof are facing each other.

The character M represents an electric motor which is mounted on the support frame 2 and revolves the horizontal drive shaft 9 through an appropriate speed reducer (not illustrated).

Said drive shaft 9 is fitted with the sprocket 14, and the aforementioned drive shaft 8 is also fitted with the sprocket 15; the endless chain 10 is stretched and engaged between said two sprockets.

An elevated edge is provided to each of the right and the left sides of the pallet 1 to strengthen the pallet as well as to prevent the wheels of the automobile from laterally skidding off the pallet.

The depression 11 is provided in the front part of the pallet to receive the wheel for the prevention of forward or backward sliding of automobile.

The manner of the operation of the various units described in connection with the FIGS. 1*a* and 2 will be explained particularly with the above exemplary embodiment of this invention.

FIG. 1*a* shows the pallet 1 lifted and stopped leaving thereunder a space available above the floor 3 for parking an automobile. At this position of the pallet 1 with the support arm 6 being approximately in an upright position, and the rear rollers 7 being at the upper ends of the guide rails 16, the electric motor is started revolving the drive shaft 9 and, through the sprocket 14, chain 10 and sprocket 15, the drive shaft 8 which rotates the support arm fixed thereon from its upright position (indicated by continuous line) toward the right (indicated by an arrow) moving the support shaft 4 held at the end of the support arm 6 along an arc. Then, the left end part of the pallet 1 descends in an arc while being pushed toward the right.

Caused by the above said archwise rotation, the support shaft 5 descends with the rollers 7 rolling along on the guide rails 16. Thus, the pallet 1 keeps itself in approximate parallel with the abovementioned lifted position during the descent and stops at a point where it is indicated by dotted line as the pallet 1'. Because of the said displacement of the pallet 1 from the lifted position down to the lowered position, the right end of the pallet 1 is now in flush contact with the surface of the floor 3, making it possible to bring in or take an automobile out of the pallet.

Said descent of the pallet 1 can be started by depressing the pushbutton of the electric motor and stopped by setting a limit-switch where it is desirable.

The pallet indicated by dotted line as the pallet 1' can be lifted keeping itself in approximate parallel with said position by reversely revolving the electric motor to rotate archwise the support arm 6 in upward direction. The pallet carries up the automobile brought in for parking thereon, making available a space under it for parking another automobile.

FIGS. 3 to 6 show another exemplary embodiment of this invention having an upper pallet and a lower pallet which are lifted or lowered simultaneously. The lower pallet in said figures is lifted or lowered in the pit dug into the ground.

Figure 4:
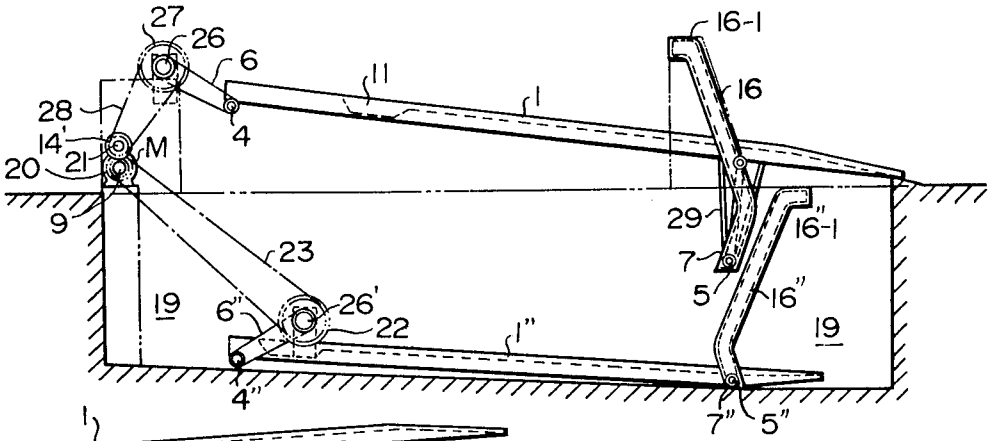
FIG. 4 shows a similar view of the second form of apparatus in the condition in which its pallets are lowered.
Figure 3:
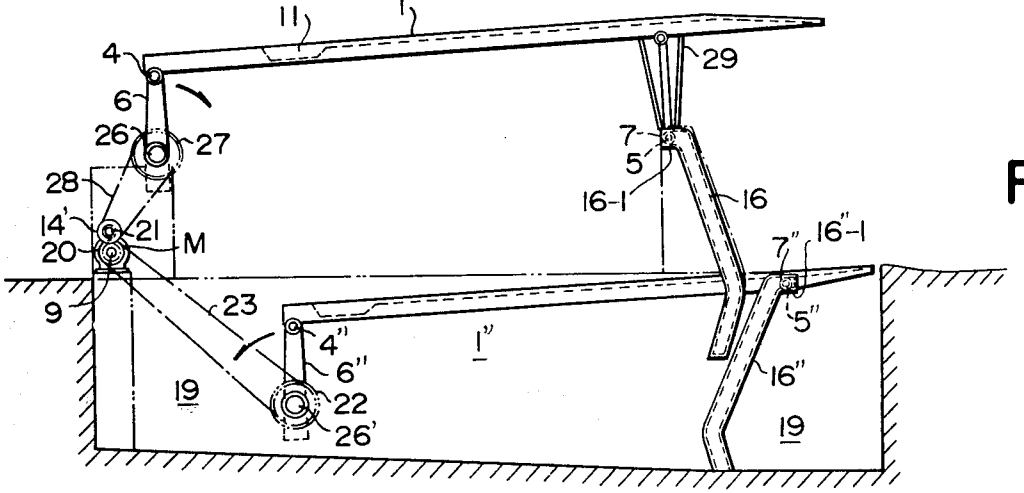
FIG. 3 shows a side elevational view of a second form of multi-stage automobile parking apparatus in the condition in which its pallets are lifted.
Figure 5:
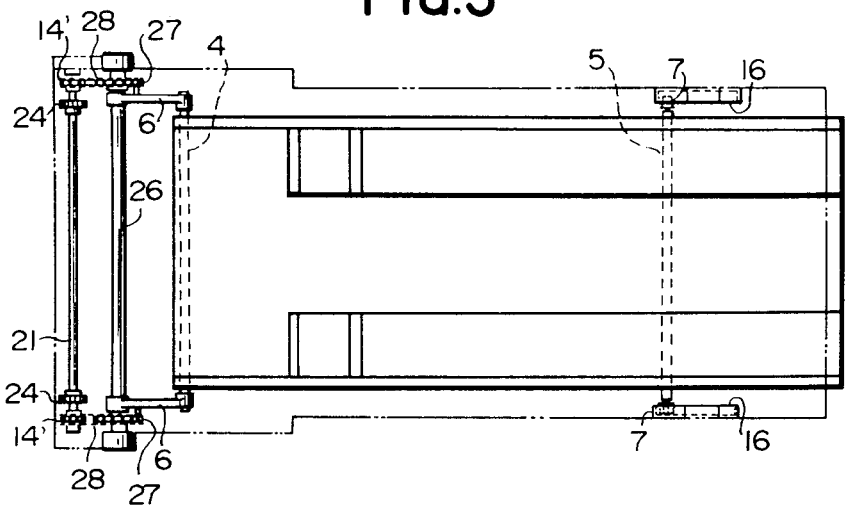
FIG. 5 shows a plan view of the upper pallet and drive mechanism of the second form of apparatus.
Figure 6:
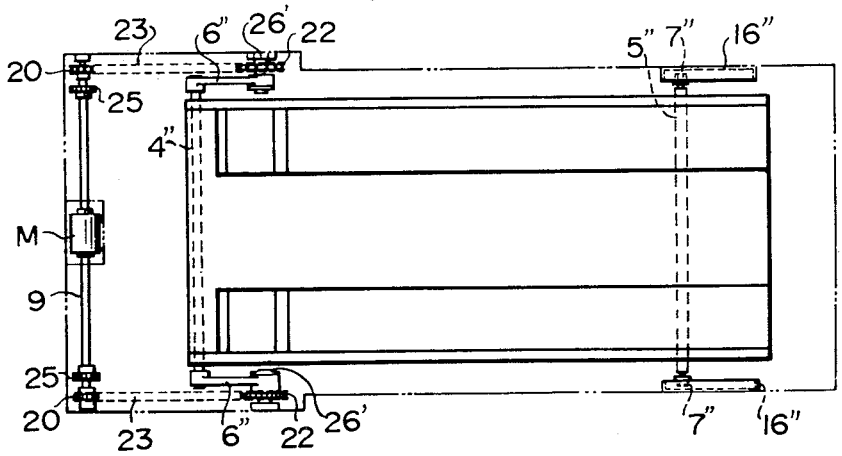
FIG. 6 shows a plan view of the lower pallet and drive mechanism of the second form of apparatus.

FIG. 3 shows the condition wherein both pallets are lifted making the lower pallet available for parking thereon or unparking therefrom an automobile, and FIG. 4 shows the condition wherein both pallets are lowered making the upper pallet available for parking thereon or unparking therefrom an automobile from the ground level.

The same numerals as those used in FIGS. 1*a* and 2 are used in the FIGS. 3 to 6 to denote those members and parts of the apparatus corresponding to the members and parts of the apparatus of the first exemplary embodiment of the invention, described above.

However, the mark '' is affixed to the numerals used for coding the lower pallet and related parts thereof corresponding to those of the apparatus of the first exemplary embodiment of the invention in order to differentiate between them, but different numerals are used for other parts.

Both upper and lower pallets are driven by one electric motor M; at both ends of the drive shaft 9 revolved by said electric motor M through a speed reducing mechanism (not illustrated) is fixed the sprocket 20; and at both ends of the horizontal drive shaft 21 supported by the right and left walls on the left of said pit is fixed the sprocket 14'. On both sides toward the left of the pit floor is rotatably held the shaft 26'; on said shaft 26' is fixed the sprocket 22; and the chain 23 is stretched between the sprocket 20 fixed at both ends of said drive shaft 9 and said sprocket 22.

At both ends of the drive shaft 21 is fixed the gear 24, and at both ends of said drive shaft 9 is fixed the gear 25 in mesh with the said gear 24.

The endless chain 28 is stretched between the sprocket 14' fixed on the drive shaft 21 and the sprocket 27 fixed on the shaft 26 held rotatably on both sidewalls toward the left of said pit.

Said gears 24 and 25 have the same diameter; the sprockets 14' and 20 have the same diameter; and the sprockets 22 and 27 have the same diameter. On the shaft 26 is fixed the support arm 6 of the upper pallet, and on the shaft 26' is fixed the support arm 6'' of the lower pallet 1'', and on the end part of said support arms are fixed the pallet support shafts 4 and 4'', respectively.

The rear support shaft 5 of the upper pallet is fixed at the end part of the comparatively tall bracket 29 fixed perpendicularly on the back of the pallet, and at both ends of said support shaft 5 are installed the rollers 7.

The rear support shaft 5'' of the lower pallet is fixed on the back of the pallet, and at both ends of the support shaft 5'' are installed the rollers 7''.

In this exemplary embodiment, the guide rails for said rollers 7 and 7'' are installed independently as shown by the numerals 16 and 16'', respectively, and are bent at an obtuse angle, tilting in opposite directions to each other and each having a horizontal part as indicated as 16-1 and 16''-1. In the figures, the side walls and the concrete support frame of the pit are shown by alternate long and short dash line.

In FIG. 3, where both upper and lower pallets are lifted and in parallel with each other, the support arms 6 and 6'' thereof are in the vertical positions. If the upper support arm 6 is driven by the electric motor and rotated rightward from the position shown in FIG. 3, the lower support arm 6'' is rotated leftward by the same angular distance as the upper support arm 6, by means of said gears of 24 and 25 in mesh and also by the ratio of diameters of said sprockets.

Caused by the rotations of said upper and lower support arms, the upper pallet moving forward to the right descends and the lower pallet drawing back to the left also descends, both pallets stopping at their respective positions shown in FIG. 4.

Although the ascending and descending movements of both upper and lower pallets of this exemplary embodiment are the same as the first exemplary embodiment described above, the support arms 6 and 6'' have the equal length and the locations and the bending or curving shapes of the upper and lower guide rails are suitably determined in order to maintain approximate parallel positions between the said upper and lower pallets during their simultaneous lifting and lowering.

It is desirable that the forward and backward movements of the upper and the lower pallets (right and left movements in FIGS. 3 and 4) be in opposite directions, as in the case of the above description.

It is also desirable that the length of the lower pallet be shorter than that of the upper pallet, which together with the opposite directions of the forward and backward movements of said upper and lower pallets will be conducive to reducing the installation area of this apparatus.

The opposite directions of the forward and backward movements or swings of said upper and lower pallets effectively reduce the space of the motion of the pallets and therefore the space to be occupied by the whole apparatus.

It is also possible that by suitably altering the shape, structure, etc. of the guide rails various structures and types of the apparatus within the scope of this invention can be devised for further stabilization of the lifting and lowering of the pallets, and simplification as well as size-reduction of the apparatus.

The characters A, B, and C in FIGS. 7*a* to 11 represent, respectively, the top, middle and bottom pallets each made of steel plates fabricated into a thin rectangular form each having a depression indicated as *a*, *b*, and *c* corresponding to A, B, and C pallets. Each pallet is furnished at its front and rear parts (the left side of the pallet being called the front part and the right side the rear part in each figure) with the horizontal support shafts 104, 121, 107, 122, 108, and 123, rotatably held by either the brackets protruding from the pallet or by the bearings installed on the edge part of the pallet. The front support shaft 108 of the bottom pallet, however, is constituted by two shorter support shafts on the right and left sides.

The character P represents a hexagonal pit dug into the ground, the outline being delineated by alternate long and short dash line or by hatched crosssection in the said figures.

On the concrete wall at both sides of the front of the pit P (in the left side of FIG. 7*a*) is installed the bearing member 119 rotatably holding the horizontal support shaft 106, in the middle of which support shaft 106 is the support arm 101, held by the pipe 102 which is rotatable around the shaft 106 having at each end the boss 109 rotatably holding the L-shaped support arm 110.

At each end of said support arm 101 and the L-shaped support arm 110 are held the support shafts 104, 107 and 108 by means of the pipe 105, the bearing boss 111, and the bearing boss 111'. The pallet rear support shafts 121, 122, and 123 are each held under a pallet by the boss on both sides of the pallet, having at its both ends the rollers R1, R2, and R3, respectively, held freely rollable on the guide rails 120 and supported by the same during rolling.

The guide rails 120 are of a T-shaped cross-section (on line X—X) and extend upwards from the floor 131 of the pit P bending in an arc toward the right (Refer to FIG. 7*a*). The rollers R1 and R2 roll along the outer sides 133 of said rails, and the roller R3 rolls along on the inner side 132 of said rails.

The web and the bottom flange sections 134 of the rails 120 are rigidly held by an appropriate structural frame (not illustrated) installed on the side walls and both sides of the pit P. The character M represents the drive motor mounted on the support board located in the front part of said pit, revolving the drive shaft S through an appropriate speed reducer (not illustrated).

On the drive shaft S are installed the wirerope winding drums D1, D2, and D3, the drum D1 being in the middle of the drive shaft S and the drum D2 on one side and the drum D3 on the other side of the drum D1, each being connected with the drive shaft S by means of a clutch (not illustrated) provided to the drive shaft S or each being able to idle on said drive shaft S by disengaging the clutch from the drum.

The drum D1 is wound with a wire rope 113, while the drums D2 and D3 are each wound with a wire rope 114. Each wire rope has one end fastened to a drum. The other end of the wire rope 113 is fastened to the metal fixture 127 pivotable in the hole of the protruding part 126 located at the top end of the support arm 101, and the other ends of the two wire ropes 114 are fastened to the metal fixtures 128, similar to the metal fixture 127, fitted at the front end part of the middle pallet.

Said wire ropes 113 and 114 are stretched by means of the pulleys 124 and 125 fitted to the common shaft 115 (not illustrated in FIGS. 4 and 5) located over said drums D1, D2, and D3.

The front part of each of the top, middle and bottom pallets is supported by the support arm 101 and the L-shaped support arm 110, both held commonly by the same horizontal support shaft 106.

The top pallet is lifted or lowered by the rotation of the support arm 101 around the support shaft 106 as the center of rotation, the middle and the lower pallets being lifted or lowered by the simultaneous rotation of the L-shaped support arms 110 around the same said support shaft 106 as the center of rotation. The lifting or lowering of the front part of each pallet is effected by winding or unwinding the wire ropes 113 and 114 by means of said drums revolved by the drive shaft driven by the drive motor.

FIG. 7*a* shows the top, middle and bottom pallets held each in the state of being able to support an automobile mounted on it, namely, each pallet is widely open realtive to the other two pallets with the middle pallet B positioned at approximately the same level as the ground level. At this position of the pallet B, the rear roller R2 thereof is at a position near the summit of the arc of the guide rail 120 and therefore is not supported by said guide rail. Hence, the front part of the pallet B is supported by the step 135 made on the wall in the rear of the aforementioned pit.

Referring now to FIG. 7*a*, when the automobile on the pallet B is taken out and therefore making said pallet B empty, the pallet A, by engaging the winding drum D1 thereof with the shaft S through a clutch to revolve said drum and thus unwinding the wire rope 113, causes by its own weight or with the weight of the automobile thereon the support arm 101 (as slightly tilted toward the right from the vertical position) to turn toward the right around the shaft 106 as the center of rotation.

Caused by this rotation, the front part of the pallet A is turned rightward by the support shaft 104, and, at the same time, the rear roller R1 rolls rightward supported by the outside surface of the arch of the guide rails 120, and the pallet A moving rightward descends, keeping an approximate horizontal position. When the pallet A descends and its end approaches the ground, the roller R1 is about to lose the support of the guide rails as the said roller moves near to the right summit of the arc of said guide rails. However, it is so designed that immediately before said roller R1 would lose the support from the guide rails, the side of the end of the pallet actuates a limit-switch or some other means to stop the pallet A so as to keep the end of the pallet above the ground, as illustrated in FIG. 8.

Referring now to FIG. 10, the ascent of the top pallet A from the position shown herein is effected by winding the wire rope 113 by means of the drum D1, reverse of the operation shown above for lowering said pallet A.

At this position of the pallet A shown in FIG. 10, an automobile can be freely brought in or taken out of the pallet A.

Referring now to FIG. 7*a*, when no automobile is on the pallet B, the front end of said pallet B is lifted sloping up-left by the wire rope 114 wound by means of the drums D2 and D3 connected with and simultaneously driven by the shaft S through a clutch. This lifting of the front end of said pallet B causes the L-shaped support arm 110 to rotate counterclockwise around the support shaft 106 as the center of rotation, and the front end parts of both pallet B and the pallet C supported by the support shafts 107 and 108 held at both ends of the support arm 110 to rotate upward. Simultaneously, the rear rollers R2 and R3 of both pallets B and C roll along on the roller supporting surface of the guide rails 120, lifting said pallets B and C in an approximately horizontal position. When the bottom pallet C comes to a position approximately flush with the ground level E, the lifting of said two pallets stops. In this case, however, the pallet B stops below the pallet A avoiding interference therewith. The length of the pallet C is so set that as said lifting of the pallets B and C proceeds the end part of the pallet C approaches the side wall of the pit without interfering therewith and comes to a position approximately flush with the ground level E.

Thus, an automobile can be freely brought in or taken out of the pallet C. Referring now to FIG. 11, the pallets B and C descend, reverse to the operation above, keeping an approximately horizontal position by revolving the drums D2 and D3 to unwind the wire rope 114, and return to the positions shown in FIG. 7*a*.

As described above, in the condition as shown in FIG. 11, by parking first an automobile on the pallet C, then by moving the pallets to the positions shown in FIG. 10 and parking another automobile on the pallet A, and by lifting the pallet A to the position shown in FIG. 7*a* and parking a still another automobile on the pallet B, it is now possible to park the three automobiles at the same time on vertically arranged three stages. Referring now to FIG. 10, in the condition described herein, by first parking an automobile on the pallet A, then by lifting the pallet B and pallet C to the positions shown in FIG. 11 and parking another automobile on the pallet C, and by lowering the pallet B and pallet C to the positions shown in FIG. 7*a* and parking a still another automobile on the pallet B, it is now possible to park the three automobiles at the same time on vertically arranged three stages.

In order to unpark all the automobiles from the three pallets, first the automobile parked on the middle pallet B is unparked therefrom, secondly the automobile on the pallet A in the condition shown in FIG. 10 is unparked, and thirdly the automobile on the pallet C in the condition shown in FIG. 11 is unparked, thus completing the unparking of all the three automobiles.

FIG. 12 is a partial side view of an embodiment of this invention having the guide rails 120 sloping in a straight form and being arranged as upper and lower two rails, with all the pallets at the same positions as those shown in FIG. 10.

As apparent from FIG. 12, in the case wherein the guide rails 120 are composed of the upper rail 120' and the lower rail 120'' each tilting in a different direction from the other, each roller is supported at any point on the sloping surface of the rail, and therefore it is not necessary particularly to make a step 135 on the side wall of the pit as shown in FIG. 7*a* and FIG. 10 to support the end of the pallet B thereon. Although it is difficult to always keep the front support shaft and rear support shaft furnished with the rollers at exactly the same height so that the pallets can be maintained always at exactly the same horizontal position during the lifting and lowering of said pallets, stable parking on the pallets can be maintained with automobiles somewhat tilting but not moving to or fro on the pallets during the lifting or lowering of the pallets.

The feature of this invention comprises the pallets each supported by the front and the rear support shafts, the front support shaft being supported at one end of the rotatable support arm and the rear support shaft being supported by the rollers on the guide rails, a structure enabling the middle and the bottom pallets to be simultaneously rotated by the front and rear support arms maintaining a set angle and each pallet to be stopped at a set height where said pallet comes to flush contact with the stage of a certain height for parking or unparking of an automobile. The above-mentioned set height in the said exemplary embodiment of this invention means a height equivalent to the depth of the pit. Because the front support arms of the middle and bottom pallets keep a set angle maintaining always a set space between the pallet front support shafts supported at the end of the support arms of both pallets, and because both pallets maintain horizontal and parallel positions, a space sufficient to park an automobile therein is maintained. Hence, although the L-shape is desirable for the support arm 110 of said middle and bottom pallets, it is not necessary if the relative positions of said two pallets can be kept the same as that kept by the L-shaped support arm. And, therefore, the phrase "keep a set angle" is used in the above description to describe said relative positions.

The phrase "the stage of a certain height" does not necessarily mean a stage formed by pit but such as stage, for example, formed by a mount built on the ground whose height is equivalent to the depth of a pit so that the pallet B can come to flush contact with the stage (Refer to FIG. 7*a*) and whose shape is so sloped down to the flat ground that an automobile, going up the said slope, can be parked on the pallet B. In this case, however, the bottom floor of the pit 131 in FIG. 7*a* corresponds to said flat ground, and the electric motor M is installed on said flat ground or mounted on a frame constructed on said flat ground standing to a height indicated in FIG. 7*a*.

Said stage can be the ground surface in relation to the floor of the basement of the building.

As described above and as apparent from FIGS. 7*a*, 10, and 11, the middle and the bottom pallets always maintain approximate parallel positions to each other, and by setting up the above said stage the support arm of each of the top, middle and the bottom pallets, rotating only about 90°, makes it possible to park automobiles in vertically arranged three stages, thus the mechanism thereof being simple, the power required to operate the mechanism small, and the operation itself easy.

Although in the case of the above exemplary embodiment of this invention, however, the single drive motor M is employed to revolve the single drive shaft, the driving of the pallets A, B, and C can be performed by a plural number of independent motors with corresponding independent drive shafts S.

Although the lifting and lowering of each pallet are performed by means of the drums and the wire ropes in said exemplary embodiment of this invention, it is also possible to use the sprocket fixed on the drive shaft and also to divide the support shaft 106 into two shafts, one for the support arm 101 and the other for the support arm 110 each with a sprocket fixed thereon, and to stretch a chain between said sprockets for the lifting and lowering of said pallets. Further, a hydraulic cylinder can be used instead of the electric motor for rotating said support arms.

Furthermore, an appropriate sequence circuit can be used to automatically operate by pushbutton depressing the starting and stopping of the drive motor, engaging and disengaging of clutches for connecting and disconnecting said drums to and from said drive shafts.

As described above, this invention makes it possible to park automobiles in vertically arranged three stages by means of a simple apparatus, thus requiring no specifically strong and complicated mechanism for the supporting, lifting, and lowering of said pallets.

In FIGS. 13, 14 and 15 the numerals 201 and 202 represent, respectively, the pallet proper, and the auxiliary plate having the same width as the pallet and held rotatably at one end of said pallet, both normally made of steel plates.

The pallet proper (hereinafter called the pallet) is furnished with the horizontal support shafts 203 and 204 at its front and rear parts, respectively, the front support shaft 203 being supported by the support arm 205 at its both ends in a manner described later, the rear support shaft 204 having at its both ends the rollers 206 on the guide rails 207 thus supporting said support shaft 204.

The left end (FIG. 13) of said support arm 205 is rotatably held by the horizontal shaft 209 supported on the structural frames 208, for example of concrete, constructed on the ground in positions facing each other with an appropriate spacing. The right side of the support arm 205 (in FIG. 13) bends straightly downward with an obtuse angle, and said bending part 210 is provided with a long slit hole 211 into which both ends of said support shaft 203 are fitted.

Although said guide rails 207 are represented as being held rigidly on the ground by an appropriate structural frame (not illustrated) and as extending in an arc toward the right and generally sloping up-left from the ground, guide rails having the same sloping in the straight line can be adopted.

The character M represents an electric motor installed on the ground for driving the pallets, revolving the drive shaft 212 through a reducer (not illustrated in the figure).

The numeral 213 represents the drum revolved around said drive shaft 212 and installed on both sides of said electric motor for winding and unwinding of the wire rope 214 used for the lifting and lowering of the pallet by rotational motion.

The one end of said wire rope 214 is fastened to the fixture 215 located at the front end of the pallet, and the other end of said wire rope is wound and fastened to the drum 213 through the grooved pulley 219 fixed on both ends of the support shaft 218 supported on the support frame which is one step higher than the concrete frame 208.

The fixture 220 is installed in a protruding manner about in the middle of both right and left sides of the auxiliary plate 202 hinged at the rear end of the pallet. One end of another wire rope 221 is fastened to said fixture 220, and said wire rope 221 extends through the wire-rope guide fixture 222 having upper and lower grooved-rollers pressing in both directions said wire rope 221 located on the side edge of the rear part of the pallet 201, and mounting around the grooved pulley 223 rotatably held at both ends of said pallet support shaft 203. Passing round said pulley, the forward end of said wire rope is fastened to the fixture 224 protruding inwardly, located at the free end of said bent support arm 210.

Thus, said wire rope 221 is so stretched from the fixture 220, through the guide fixture 222 and round the pulley 223 to the fixture 224 that it is always kept in tension.

The description of the operation of the two-staged parking apparatus will be given hereunder by reference to the above exemplary embodiment of this invention.

In the condition wherein said pallet 201 is kept horizontal, both ends of the front support shaft of the pallet 201 are lifted to the top of the long slit hole 211 of the bent support arm 210 by the winding of the wire rope 214 on the drum 213 and are kept stationary, the auxiliary plate 202 located at the end of the pallet 201 being in an approximately vertical position.

In the condition described above, by unwinding the wire rope 214 from the drum 213 by means of the electric motor M, the front support shaft 203 descends along the tilting line of the long slit hole 211 of the bent support arm 210 by virtue of the weight of the pallet, and stops at the lower end of the long slit hole 211. Caused by such descent of the front support shaft 203, the rear support shaft 204 of the pallet also descends as the rollers 206 roll down along on the arched guide ralis 207. If the curvature or the tilting angle of the guide rails 207 is so set that the straight vertical distance of the travel of said rear support shaft 204 is greater than that of said front support shaft 203, the pallet 201 starts to descend keeping approximately horizontal position but gradually tilting down backwards as the pallet continues to descend, and stops at a small angle in tilting position indicated by numeral 201' delineated by alternate long and short dash line in FIG. 13. Caused by said descending motion of the pallet, the pallet support shaft 203 descends along the groove hole 211, and because the pulley 223 on the support shaft around which the wire rope 221 is wound in tension approaches the wire-rope fixture 224 located at an end of the support arm 210, the wire rope 221 is permitted to extend rightward equivalent to approximately double the travel distance of the pulley 223. With the rightward extension of said wire rope the auxiliary plate 202 hinged at the end of the pallet rotates rightward on the pivotal center by its weight, occupying the position indicated as 202' in FIG. 13 by the alternate long and short dash line, touching the ground by its tip at the point where the extended line of the pallet comes in contact with the ground at an angle approximately the same as the tilting angle of the pallet, and stopping by the tension of the wire rope 221.

Thus, said pallet 201 with its auxiliary plate 202 is rigidly held, tilting gently against the ground, making itself available for parking thereon or unparking therefrom.

The numeral 225 represents the depression located in the front part of the pallet for preventing the wheels of the automobile from skidding or sliding to or fro on the pallet.

When the wire rope 214 is wound on the drum 213 by means of the electric motor M while said pallet 201 and the auxiliary plate 202 are in the tilting condition, the pallet front support shaft 203 is lifted along the tilting long slit hole 211 of the support arm 210, and simultaneously the pallet rear support shaft 204 is also lifted as the rollers 206 roll along on the guide rails 207. When the support shaft 203 reaches the top end of the long slit hole 211 of the support arm 210, the pallet 201 comes to a horizontal position. Until this state is reached, the support arm 205 is held to remain in the horizontal.

Along with the lifting of said pallet the wire rope 221, because of the support arm 203 moving upward along the long slit hole 211, is wound and shortened leftward, reverse to the extension thereof in the case of the descent of the said pallet. Hence, the wire rope 221, gradually rotating the auxiliary plate 202', comes to an approximately perpendicular position slightly tilting toward the right when the pallet reaches the horizontal position.

If the winding of the wire rope 214 is continued, the support arm 205 is rotated counter-clock wise by the pallet support shaft 203 around the horizontal shaft 209 as the center of rotation; the pallet left end is lifted archwise; and the pallet rear support shaft 204 is also lifted as the rollers 206 roll along on the guide rails 207, thus keeping the pallet in an approximate horizontal position. The pallet stops when it reaches a set height.

Following this, when the pallet 201 reaches the position 201'' in FIG. 13, a space thereunder is available for parking or unparking of an automobile, thus enabling the two automobiles to be parked in vertically arranged two stages.

While the pallet is being lifted from its horizontal position 201 to the position 201'', the wire rope 221 does not change its condition of being stretched in tension, and therefore the auxiliary plate 202 does not change its condition either.

If, therefore, the height of the horizontal pallet 201 indicated by continuous line in FIG. 13 is set sufficiently large for parking an automobile in the space, it is possible to effect the two staged parking of automobiles by sliding upward the support shaft 203 along the long slit hole 211 of the bent support arm 210 with the support arm 205 keeping its horizontal position, without rotating the said support arm 205 upward as described above.

FIGS. 16 and 17 show the pallets 226 and 227 which have, respectively, the front support shafts 228 and 229 and the rear support shafts 230 and 231, the said front support shafts being supported by the support arms 232 and 233, respectively, and said rear support shafts being supported by the rollers 234 and 235 held at both ends of said shafts, respectively, supported and roll along on the curved or straight rails 236 which are rigidly fixed at one end on the ground.

The plan view and the side view of this exemplary apparatus embodying the invention are omitted because the pallet supporting mechanism for this apparatus is the same as that of the aforementioned apparatus embodying the invention shown in FIGS. 13 and 15.

The numeral 237 represents a supporting frame, for example of concrete, to mount thereon the electric motor M and the bearing support section 238 of said support arm 232, and said supporting frame 237, guide rails 236, support arms 232 and 233, etc. are installed symmetrically on the right and the left sides with a sufficient space for parking an automobile in between.

The support arms 232 and 233 are held rotatably on the horizontal shafts 239 and 240 as the centers of rotation, supported by the bearing supporting section 238.

Said horizontal shafts 239 and 240 are supported, having appropriate spaces both above and under. Said support arms 232 and 237 are bent at an obtuse angle near the end, and along the total length of the bent parts 241 and 242 are made the long slit holes 243 and 244 into which the support shafts 228 and 229 are fitted and slide.

At one end of each of the pallets is hinged the auxiliary plate 245 and 246 of the same width as that of the pallets. Between said auxiliary plates 245 and 246 and the pallets 226 and 227 are stretched in tension the wire ropes 247 and 248, similarly to the wire rope 221 in the aforementioned exemplary embodiment of this invention.

Although not illustrated, the wire-rope winding drums fixed on the drive shaft 249 revolved by the electric motor M and through the pulleys 250 are used to wind the wire ropes 251 and 252 whose one end is fastened to the front end (left end) of each pallet.

The functioning and operation of this exemplary apparatus embodying the invention are as follows.

Referring now to FIG. 16, in the condition shown therein, if the automobile is unparked from under the pallet 227, or after the automobile has been moved slightly leftward, the lower pallet 227 and the auxiliary plate 246 gradually descend by unwinding the wire rope 252 and come to the positions 201' and 202', respectively, as shown in FIG. 13, allowing an automobile to be parked or unparked on said pallet 227.

Said pallet 227 kept in the abovementioned condition and made empty, the pallet 227 and the auxiliary plate 245 gradually descend by unwinding the wire rope 251 and come to the positions shown in FIG. 17, making available the space on the pallet 226 for parking or unparking an automobile.

In the condition shown in FIG. 17, by winding the wire ropes 251 and 252 the pallets 226 and 227 can be lifted gradually and come to the positions shown in FIG. 16.

Hence, by always keeping the support arm 233 in the horizontal and also by winding and unwinding the wire ropes 252 and 251 by means of the drums, it is possible to park automobiles in vertically arranged three stages.

What is claimed is:

1. A multi-stage automobile parking apparatus which comprises:

pallet means for receiving and supporting an automobile thereon;

support arm means, means mounting said support arm means to rotate about a horizontal axis at one end thereof and connecting its other end to one end region of said pallet means, first pallet guide means on said support arm means to facilitate pivotal movement of one end of said pallet means about said horizontal axis and sliding movement of one end of said pallet means thereon in the longitudinal direction thereof;

second pallet guide means for guiding said pallet means at an opposite end region thereof and defining a predetermined path of movement for said opposite end region of the pallet, means on said pallet means for engaging said first and second guide means;

drive means, connection means drivingly connecting said drive means with said pallet means and support arm means to bring about rotation thereof about said horizontal axis such that one end of said pallet means rotates with respect to the support arm means about said horizontal axis while the opposite end region of the pallet travels along said predetermined path of said second guide means so that said pallet means is maintained substantially horizontal during rotation of the support arm means about said horizontal axis; and auxiliary plate means, hinge means connecting said auxiliary plate means to said pallet means at one end thereof remote from said support arm means, connecting means connecting said auxiliary plate means with said support arm means such that said auxiliary plate means is pivoted between a first and second position in response to movement of said support arm means.

2. A multi-staged automobile parking apparatus as claimed in claim 1, wherein said means connecting said other end of the support arm means to said one end region of the pallet means comprises a horizontal support shaft.

3. A multi-staged automobile parking apparatus as claimed in claim 2, wherein said first pallet guide means comprises an extension portion at said other end of the support arm means and formed with a slit which extends downwardly from said other end of the support arm means when the support arm means is in a lowered position thereof and in which the horizontal support shaft is slidably fitted.

4. A multi-staged automobile parking apparatus as claimed in claim 1, wherein the auxiliary plate means is connected with said support arm means by an elongate, flexible, substantially inextensible member which extends from a region of the auxiliary plate means which is spaced from the hinge means to a region of the first guide means at that end of the path of sliding movement, of said one end of said pallet means along the first guide means, which is further from said one end of the support arm means and is constrained to pass through first pulley means installed at said opposite end region of the pallet but spaced from the hinge means and through second pulley means at said one end region of the pallet means.

5. A multi-staged automobile parking apparatus as claimed in claim 1, wherein the pallet means is provided at said opposite end region with a horizontal support shaft extending substantially parallel to said horizontal axis and provided at its opposite ends with respective roller members, and wherein said second guide means constitutes a pair of guide rails at opposite sides respectively of the pallet and engaged by the roller members respectively.

6. A multi-staged automobile parking apparatus as claimed in claim 1, wherein the connection means connecting said drive means with said pallet means and support arm means comprises a winding rope.

7. A multi-staged automobile parking apparatus as claimed in claim 1, further comprising:

second pallet means positioned beneath said pallet means for receiving and supporting a second automobile thereon;

second support arm means, means mounting said second support arm means to rotate about a horizontal axis at one end thereof and connecting its other end to one end region of said second pallet means;

third pallet guide means on said second support arm means to facilitate pivotal movement of one end of said second pallet means about said horizontal axis at said one end of the second support arm means, the second pallet means being guided at an opposite end region thereof by said second pallet guide means which defines a predetermined path of movement for said opposite end region of the second pallet means;

means on said second pallet means engaging said second and third pallet guide means; and second connection means drivingly connecting said drive means with said second pallet means and second support arm means to bring about rotation thereof about said horizontal axis at said one end of the second support arm means such that said one end of said second pallet means rotates with respect to the second support arm means about said horizontal axis at said one end of said second support arm means while the opposite end region of the second pallet means travels along its predetermined path of movement defined by said second pallet guide means so that said second pallet means is maintained substantially horizontal during such rotation of the second support arm means.

8. A multi-staged automobile parking apparatus as claimed in claim 7, wherein a lower portion of the predetermined path of movement for the opposite end region of said pallet means coincides with an upper portion of the predetermined path of movement for the opposite end region of said second pallet.

9. A multi-staged automobile parking apparatus as claimed in claim 7, wherein the axis of rotation of said support arm means coincides with said axis of rotation of the second support arm means.

* * * * *